US010081182B2

(12) United States Patent
Kikuchi et al.

(10) Patent No.: US 10,081,182 B2
(45) Date of Patent: Sep. 25, 2018

(54) LIQUID DISCHARGE HEAD, LIQUID DISCHARGE DEVICE, AND LIQUID DISCHARGE APPARATUS

(71) Applicants: Atsushi Kikuchi, Kanagawa (JP); Yoshitaka Fujinuma, Ibaraki (JP); Junichi Iwata, Ibaraki (JP)

(72) Inventors: Atsushi Kikuchi, Kanagawa (JP); Yoshitaka Fujinuma, Ibaraki (JP); Junichi Iwata, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/431,693

(22) Filed: Feb. 13, 2017

(65) Prior Publication Data

US 2017/0232741 A1 Aug. 17, 2017

(30) Foreign Application Priority Data

Feb. 15, 2016 (JP) ..... 2016026324
Feb. 26, 2016 (JP) ..... 2016035496
Oct. 13, 2016 (JP) ..... 2016201450

(51) Int. Cl.
*B41J 2/175* (2006.01)
*B41J 2/14* (2006.01)
*H01R 12/77* (2011.01)

(52) U.S. Cl.
CPC ..... *B41J 2/1433* (2013.01); *H01R 12/77* (2013.01); *B41J 2002/14491* (2013.01)

(58) Field of Classification Search
CPC ..... B41J 2/1433; B41J 2002/14491; B41J 2/17553; B41J 2/17513; B41J 2/17523; H01R 12/77
See application file for complete search history.

(56) References Cited

U.S. PATENT DOCUMENTS

2005/0243130 A1* 11/2005 Essen ..... B41J 2/14072 347/50
2011/0242166 A1* 10/2011 Miyajima ..... B41J 2/14274 347/9
2013/0182044 A1* 7/2013 Kinokuni ..... B41J 2/17526 347/50

FOREIGN PATENT DOCUMENTS

JP 2007-015268 1/2007
JP 2011-005869 1/2011
JP 2012-192717 10/2012
JP 2013-144409 7/2013

* cited by examiner

*Primary Examiner* — Jason Uhlenhake
(74) *Attorney, Agent, or Firm* — Duft Bornsen & Fettig LLP

(57) ABSTRACT

A liquid discharge head includes a head body, a wiring member, a connector, and a protector. The head body discharges liquid. The wiring member transmits a signal to the head body. The connector is disposed at the wiring member to connect the wiring member to the head body. The protector covers the head body and the connector. The head body includes a fitting portion. The protector includes a fitting portion to fit the fitting portion of the head body in a fitting direction. The connector is disposed more backward than a leading end of the fitting portion of the protector in the fitting direction.

13 Claims, 15 Drawing Sheets

LIQUID DISCHARGE HEAD, LIQUID DISCHARGE DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application Nos. 2016-026324 filed on Feb. 15, 2016, 2016-035496 filed on Feb. 26, 2016, and 2016-201450 filed on Oct. 13, 2016 in the Japan Patent Office, the entire disclosure of each of which is hereby incorporated by reference herein.

BACKGROUND

Technical Field

Aspects of the present disclosure relate to a liquid discharge head, a liquid discharge device, and a liquid discharge apparatus.

Related Art

As a liquid discharge head (droplet discharge head) to discharge liquid, for example, a head and a wiring member, such as a flexible wiring member may be detachably connected to each other via a connector.

SUMMARY

In an aspect of the present disclosure, there is provided a liquid discharge head that includes a head body, a wiring member, a connector, and a protector. The head body discharges liquid. The wiring member transmits a signal to the head body. The connector is disposed at the wiring member to connect the wiring member to the head body. The protector covers the head body and the connector. The head body includes a fitting portion. The protector includes a fitting portion to fit the fitting portion of the head body in a fitting direction. The connector is disposed more backward than a leading end of the fitting portion of the protector in the fitting direction.

In another aspect of the present disclosure, there is provided a liquid discharge device that includes the liquid discharge head to discharge liquid.

In still another aspect of the present disclosure, there is provided a liquid discharge apparatus that includes the liquid discharge device to discharge the liquid.

In still yet another aspect of the present disclosure, there is provided a liquid discharge apparatus that includes the liquid discharge head to discharge the liquid.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
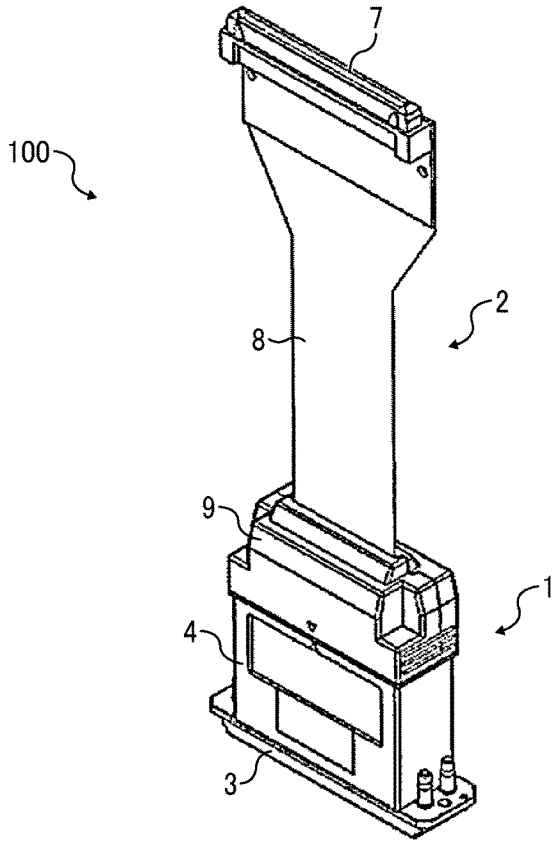
FIG. 1 is an outer perspective view of a liquid discharge head according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Figure 2:
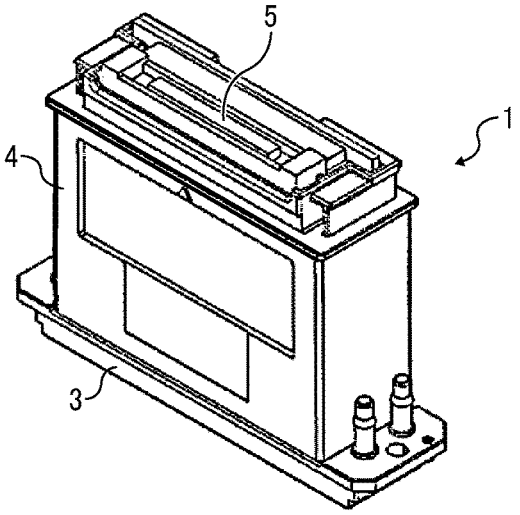
FIG. 2 is an outer perspective view of a head body of the liquid discharge head of FIG. 1.
Figure 3:
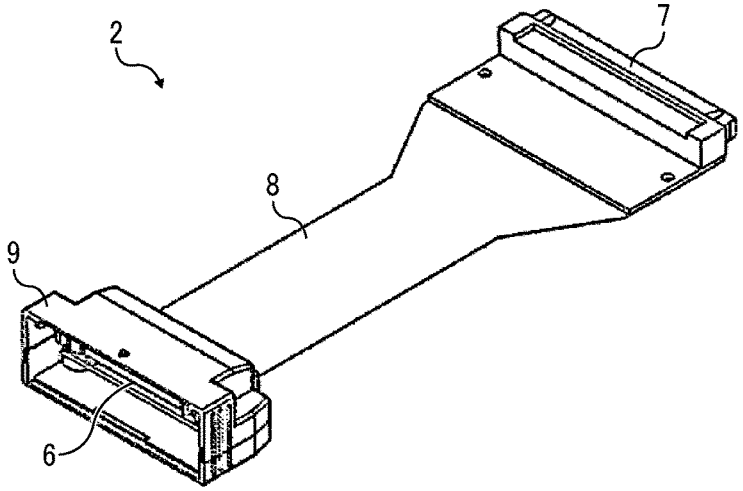
FIG. 3 is an outer perspective view of a cable unit of the liquid discharge head of FIG. 1.

Below, embodiments of the present disclosure are described with reference to the attached drawings. A liquid discharge head according to an embodiment of the present disclosure is described with reference to FIGS. 1 to 3. FIG. 1 is an outer perspective view of the liquid discharge head according to the present embodiment. FIG. 2 is an outer perspective view of a head body of the liquid discharge head of FIG. 1. FIG. 3 is an outer perspective view of a cable unit of the liquid discharge head of FIG. 1.

The liquid discharge head 100 includes a head body 1 and a cable unit 2 removably attached to the head body 1.

The head body 1 includes a discharger 3. The discharger 3 includes, e.g., a plurality of nozzles to discharge liquid, a plurality of individual liquid chambers communicated with the nozzles, a plurality of pressure generators to generate pressure to pressurize liquid in the individual liquid chambers, and a common liquid chamber to supply liquid to the individual liquid chambers.

The head body 1 further includes a cover 4 to cover the outer circumference of, e.g., a liquid supply passage member to supply liquid to the discharger 3. The cover 4 covers the head body 1 to prevent liquid from entering the inside of the head body 1 even if liquid scatters from the inside of a supply tube when the supply tube is inserted or removed in the attachment or replacement of the liquid discharge head 100.

When the liquid discharge head 100 takes a position so that the liquid discharge direction is downward (hereinafter, "upward" and "downward" are used assuming the position, a head-side connector 5 is disposed in an exposed state on an upper portion of the cover 4.

The cable unit 2 is detachably connected to the head-side connector 5 of the head body 1 and is connected to, e.g., a controller disposed at an apparatus body side. Thus, the liquid discharge head 100 is connected to the controller at the apparatus body side. Note that the cable unit 2 may be connected to a relay board on a carriage on which the liquid discharge head 100 is mounted.

The cable unit 2 includes a wiring member 8, such as a flexible wiring member, a wiring-member-side connector 6 connected to one end of the wiring member 8, and a wiring-member-side connector 7 connected to the other end of the wiring member 8. In the present embodiment, the wiring-member-side connector 6 is disposed at the wiring member 8 to connect the head body 1 to the wiring member 8.

A cover 9 as a protector to cover the head body 1 and the wiring-member-side connector 6 is disposed at the wiring-member-side connector 6. In the present embodiment, the cover 9 is fit to the head body 1 to cover the entire of an electrical connector constituted by connecting the wiring-member-side connector 6 to the head-side connector 5. Note that the wiring-member-side connector 6 is connected to the apparatus body side.

Figure 4:
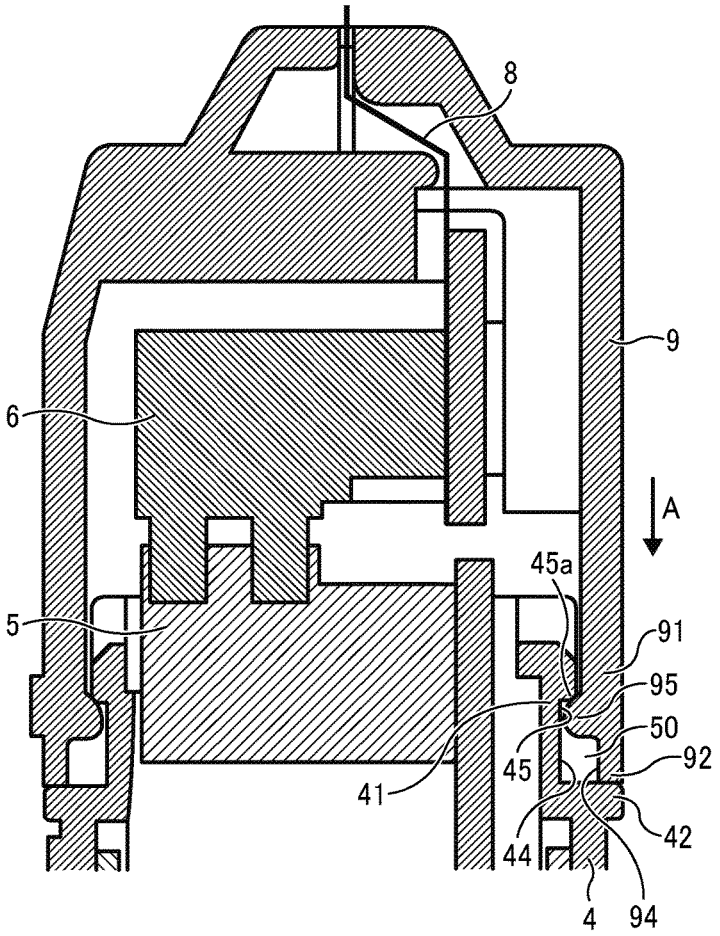
FIG. 4 is a cross-sectional view of a portion around an electrical connector in a first embodiment of the present disclosure.
Figure 5:
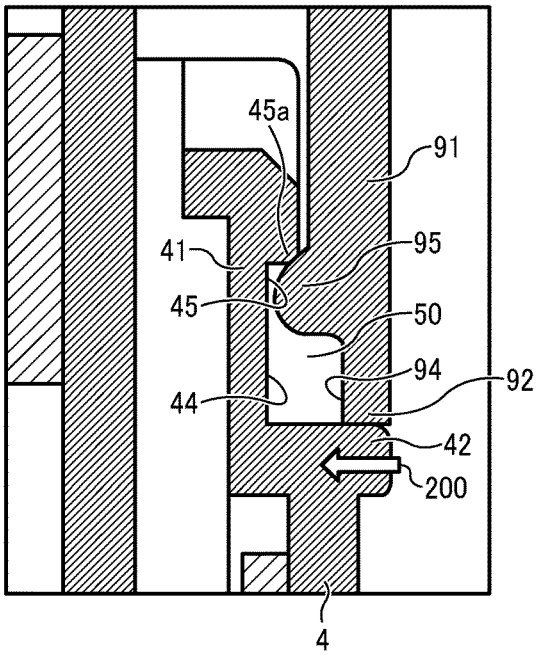
FIG. 5 is a partially-enlarged view of FIG. 4.

Next, a first embodiment of the present disclosure is described with reference to FIGS. 4 and 5. FIG. 4 is a cross-sectional view of a portion around the electrical connector in the first embodiment. FIG. 5 is a partially-enlarged view of FIG. 4.

The cover 4 of the head body 1 and the cover 9 of the cable unit 2 includes a fitting portion 41 and a fitting portion 91 to engage each other. A leading end 92 (hereinafter, "opposing portion 92") of the cover 9 in a fitting direction (indicated by arrow A in FIG. 4) opposes a step portion 42 (hereinafter, "opposing portion 42") of the cover 4.

In the present embodiment, the fitting portion 41 of the cover 4 is disposed at an inner circumferential side and the fitting portion 91 of the cover 9 is disposed at an outer circumferential side. Note that, in some embodiments, the fitting portion 41 of the cover 4 is disposed at the outer circumferential side and the fitting portion 91 of the cover 9 is disposed at the inner circumferential side.

The opposing portion 92 of the cover 9 and the opposing portion 42 of the cover 4 preferably contact each other. However, in some embodiments, the opposing portion 92 of the cover 9 and the opposing portion 42 of the cover 4 may not contact each other.

A recessed portion 44 is disposed at an outer circumferential surface side of the fitting portion 41 of the cover 4. A cutout portion 94 is disposed at the inner circumferential surface of the fitting portion 91 of the cover 9, to form a space 50 in which the clearance between the fitting portion 41 and the fitting portion 91 is partially broadened. Note that the recessed portion 44 of the fitting portion 41 is disposed over the entire circumference of the fitting portion 41 in the circumferential direction of the fitting portion 41. Similarly, the cutout portion 94 of the fitting portion 91 is disposed over the entire circumference of the fitting portion 91 in the circumferential direction of the fitting portion 91.

An engagement recessed portion 45 as an engagement portion is disposed in continuous with the recessed portion 44 at the outer circumferential surface of the fitting portion 41 of the cover 4. A hook portion (engagement convex portion) 95 as an engagement portion to engage the engagement recessed portion 45. When the hook portion 95 engages the engagement recessed portion 45, a step portion 45*a* restricts the movement of the cover 9 in a direction opposite the fitting direction, thus preventing looseness and dropping of the cover 9.

Figure 6:
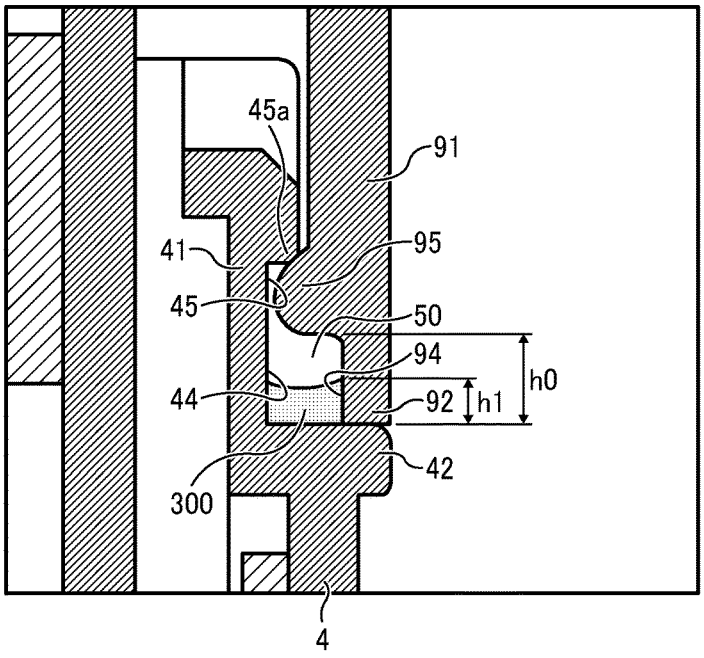
FIG. 6 is an enlarged cross-sectional view of a portion around the electrical connector in the first embodiment.
Figure 7:
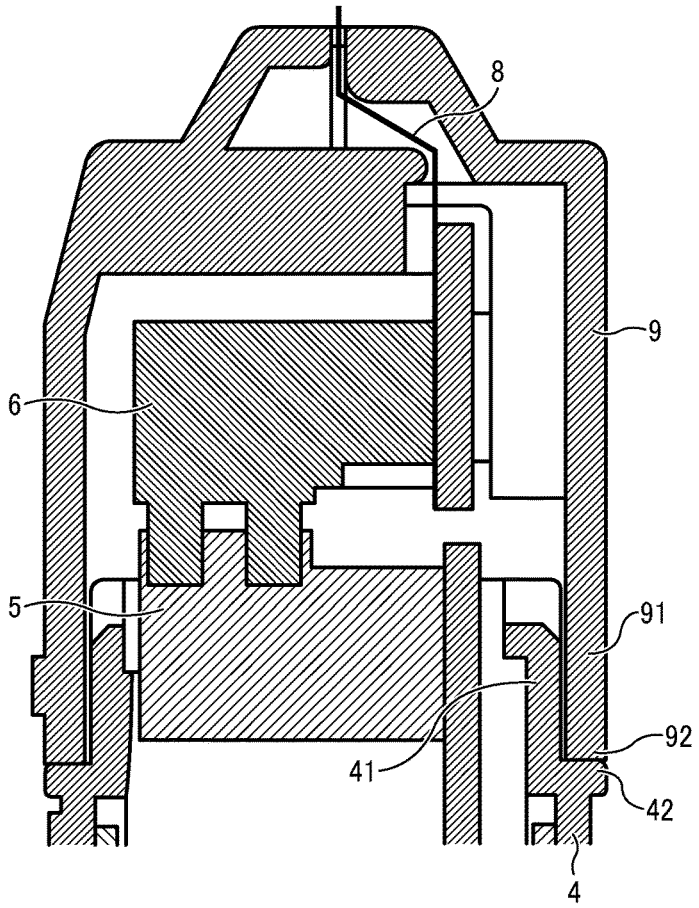
FIG. 7 is a cross-sectional view of a portion of a comparative example.
Figure 8:
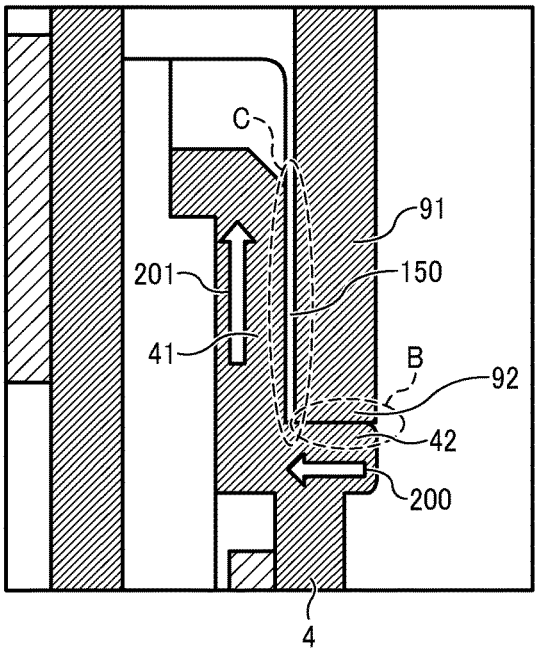
FIG. 8 is a partially-enlarged view of the comparative example of FIG. 7.

Next, operation of the present embodiment is described together a comparative example with reference to FIGS. 6 to 8. FIG. 6 is an enlarged cross-sectional view of a portion around the electrical connector in the present embodiment. FIG. 7 is a cross-sectional view of a portion of a comparative example. FIG. 8 is a partially-enlarged view of FIG. 7.

In the comparative example, the recessed portion 44 and the cutout portion 94 in the present embodiment are not disposed at the outer circumferential surface of the fitting portion 41 of the cover 4 and the inner circumferential surface of the fitting portion 91 of the cover 9, respectively. In the present embodiment, a clearance 150 is formed between the outer circumferential surface of the fitting portion 41 and the inner circumferential surface of the fitting portion 91.

In the configuration (structure) of the comparative example, when the cover 9 is fitted to the cover 4, a clearance due to asperities of components or dimensional tolerance arises at a portion (indicated by B in FIG. 8) between the leading end 92 of the fitting portion 91 and the step portion 42 of the cover 4.

Accordingly, if liquid adheres to the circumferential surfaces of the cover 4 and the cover 9 around the portion B by mist in operation or handling of liquid in maintenance, as indicated by arrow 200 in FIG. 8, liquid may enter the inside of the cover 9 from the clearance at the portion B by capillarity.

Liquid having entered the inside of the cover 9, as indicated by arrow 201 in FIG. 8, further enters the inside in an area (indicated by C in FIG. 8) of the clearance 150 between the outer circumferential surface of the fitting portion 41 and the inner circumferential surface of the fitting portion 91. Accordingly, liquid may arrive at the head-side connector 5 can cause electrical failure.

Here, even if the clearance 150 between the fitting portion 41 of the cover 4 and the fitting portion 91 of the cover 9 is broaden, the cover 4 and the cover 9 may rattle, thus causing the cover 9 to be dropped by, e.g., vibration during operation. When the clearance 150 between the fitting portion 41 of the cover 4 and the fitting portion 91 of the cover 9 is narrow, the wiring-member-side connector 6 can be inserted into and positioned relative to the head-side connector 5 by only mounting the cover 9. However, if the clearance 150 between the fitting portion 41 of the cover 4 and the fitting portion 91 of the cover 9 is broaden, misalignment might occur and cause wrong insertion of the connector 6.

In such a case, the clearance 150 between the fitting portion 41 of the cover 4 and the fitting portion 91 of the cover 9 can be sealed with a sealant, such as a gasket. However, the sealant need be resistant to the liquid to be used. Change of the liquid to be used inconveniently requires change of the sealant.

By contrast, in the present embodiment, as illustrated in FIG. 6, the recessed portion 44 and the cutout portion 94 are disposed at the fitting portion 41 of the cover 4 and the fitting portion 91 of the cover 9, respectively, to partially form the space 50 broader than the clearance between the opposing portion 42 and the opposing portion 92.

Accordingly, liquid 300 entering the inside from the clearance between the opposing portion 42 and the opposing portion 92 by capillarity enters the space 50. The space 50 broader than the clearance between the opposing portion 42 and the opposing portion 92 generates a smaller capillary force than a capillary force of the clearance between the opposing portion 42 and the opposing portion 92. Such a configuration reduces further entry of the liquid having entered the space 50 toward the inside, thus remaining the liquid 300 in the space 50.

In other words, for the capillarity, the movement amount of liquid is defined by, e.g., the physical properties of liquid, such as the surface tension and density of liquid, and the diameter of tube (the clearance between the fitting portion 41 and the fitting portion 91). Therefore, as illustrated in FIG. 6, the rising amount h1 of liquid entering the space 50 can be reduced by setting the space 50 to be broader than the clearance between the opposing portion 42 and the opposing portion 92. Hence, liquid can be remained in the space 50 by setting the height h0 of the space 50 to be higher than the maximum rising amount of the liquid entering the space 50.

Such a configuration can reduce entry of liquid into the electrical connector of the head body.

Figure 9:
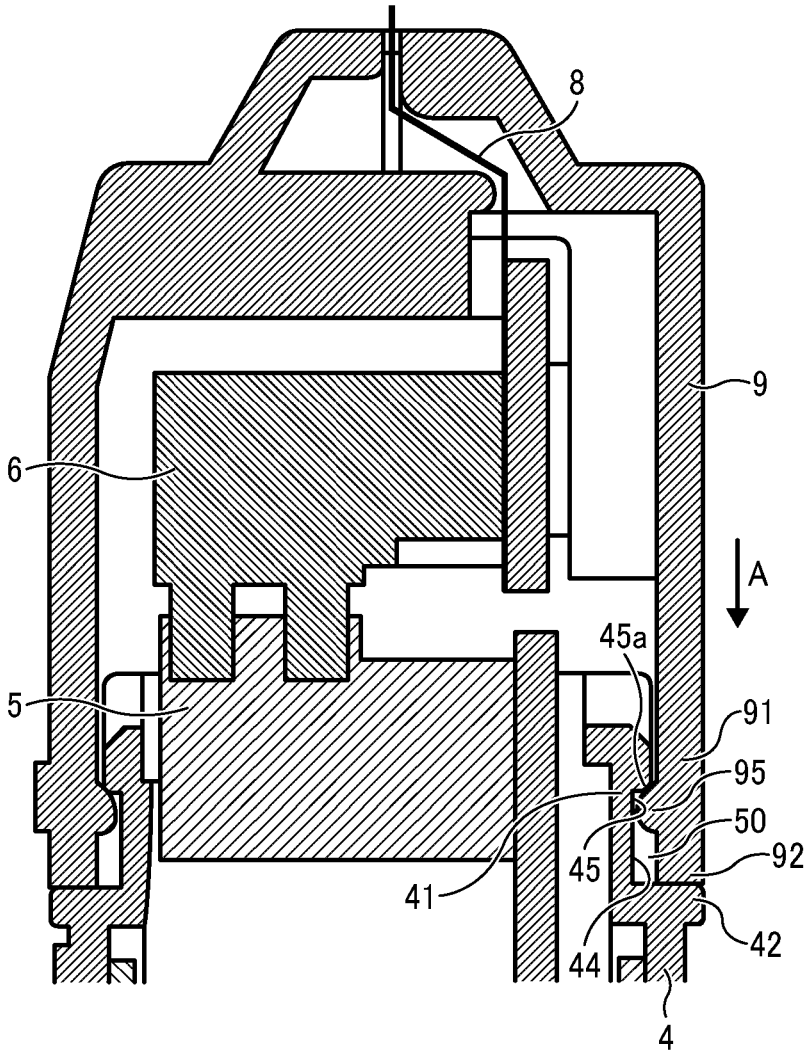
FIG. 9 is a cross-sectional view of a portion around an electrical connector in a second embodiment of the present disclosure.

Next, a second embodiment of the present disclosure is described with reference to FIG. 9. FIG. 9 is a cross-sectional view of a portion around the electrical connector in the second embodiment.

In the present embodiment, the recessed portion 44 is disposed at the fitting portion 41 of the cover 4 to form the space 50 in which the clearance between the fitting portion 41 and the fitting portion 91 is partially broadened.

In the present embodiment, the clearance between the fitting portion 41 of the cover 4 and the fitting portion 91 of the cover 9 is narrower than in the first embodiment. However, the clearance between the fitting portion 41 of the cover 4 and the fitting portion 91 of the cover 9 is broader than the clearance between the opposing portion 42 and the opposing portion 92, thus allowing liquid to be remained in the space 50.

Figure 10:
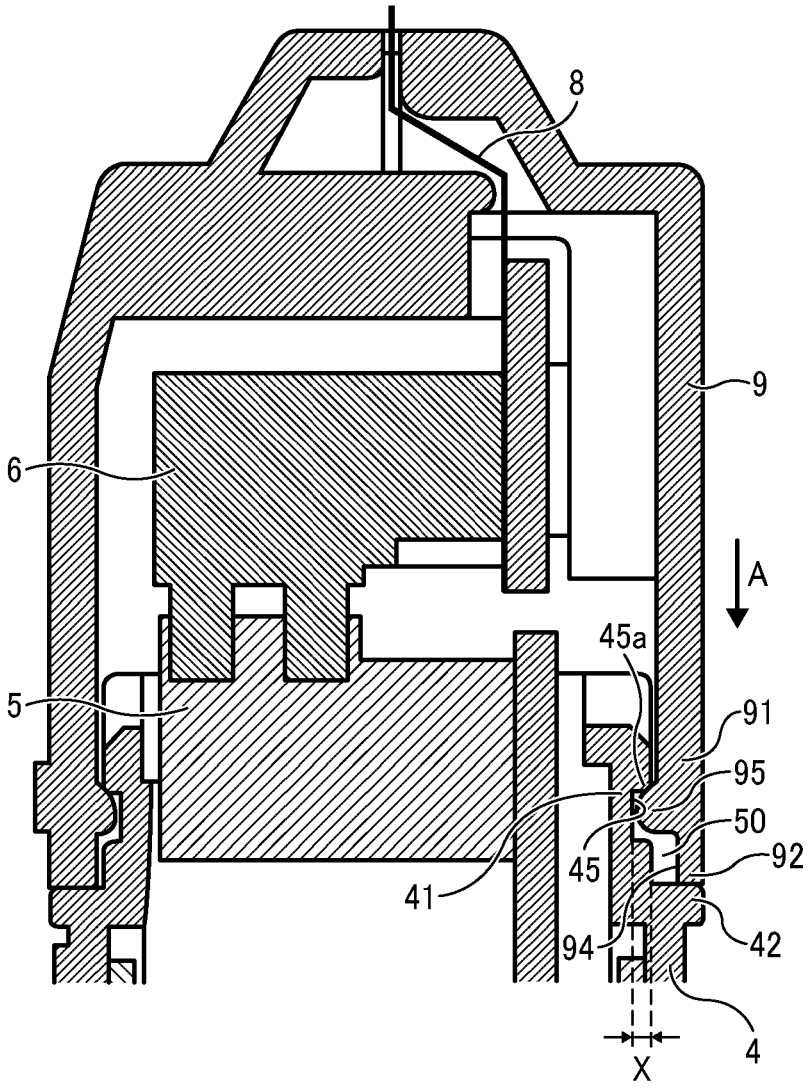
FIG. 10 is a cross-sectional view of a portion around an electrical connector in a third embodiment of the present disclosure.

Next, a third embodiment of the present disclosure is described with reference to FIG. 10. FIG. 10 is a cross-sectional view of a portion around the electrical connector in the third embodiment.

In the present embodiment, the cutout portion 94 is disposed at the fitting portion 91 of the cover 9 to form the space 50 in which the clearance between the fitting portion 41 and the fitting portion 91 is partially broadened. For example, the engagement recessed portion 45 has a step X.

In the present embodiment, the clearance between the fitting portion 41 of the cover 4 and the fitting portion 91 of the cover 9 is narrower than in the first embodiment. However, the clearance between the fitting portion 41 of the cover 4 and the fitting portion 91 of the cover 9 is broader than the clearance between the opposing portion 42 and the opposing portion 92, thus allowing liquid to be remained in the space 50.

By the step X, the space 50 is disposed at an outer side of the liquid discharge head than the space 50 in the first embodiment. Accordingly, the space 50 is more distant from the inside of the liquid discharge head than in the first embodiment, thus reducing entry of the liquid 300 into the inside of the liquid discharge head.

Figure 11:
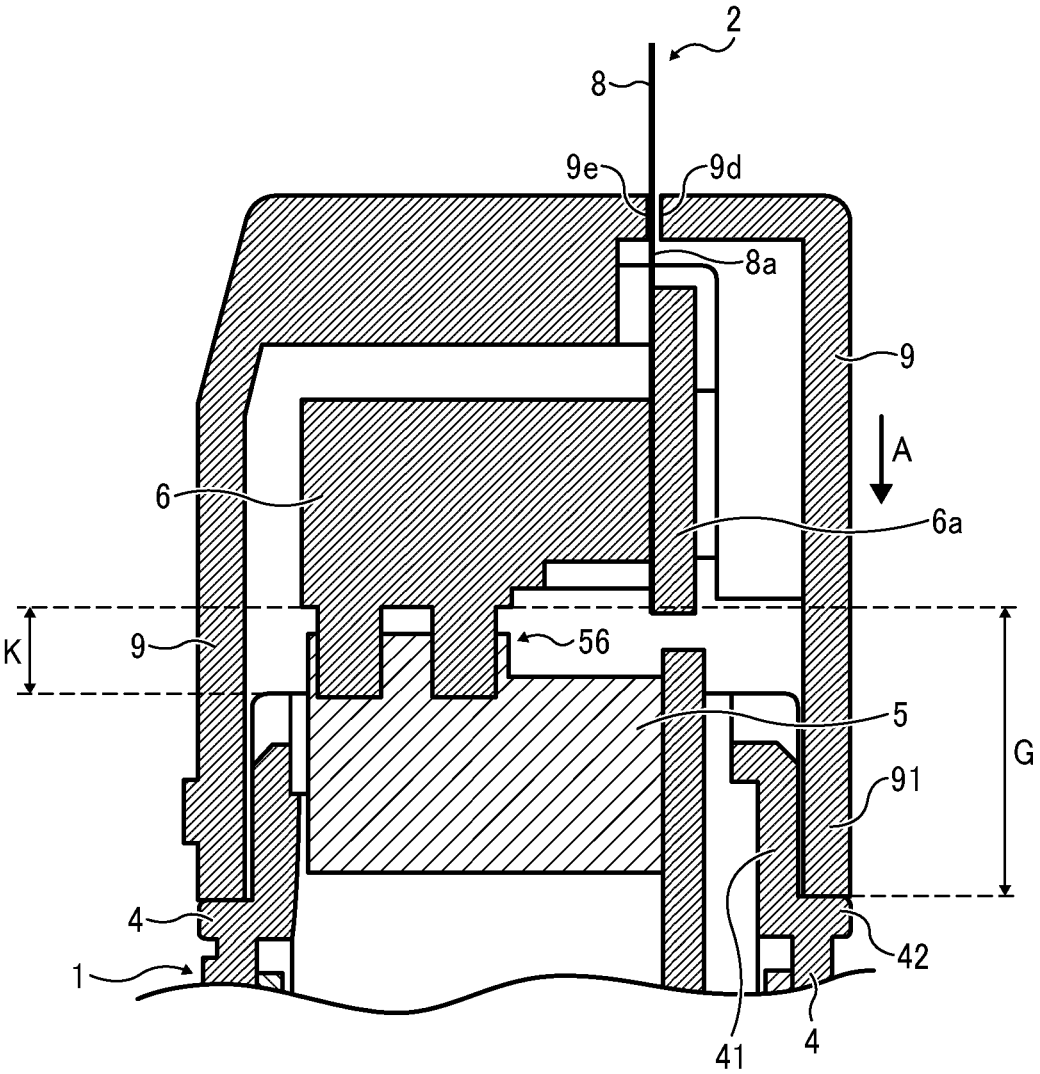
FIG. 11 is a cross-sectional view of a portion around an electrical connector in a fourth embodiment of the present disclosure.
Figure 12:
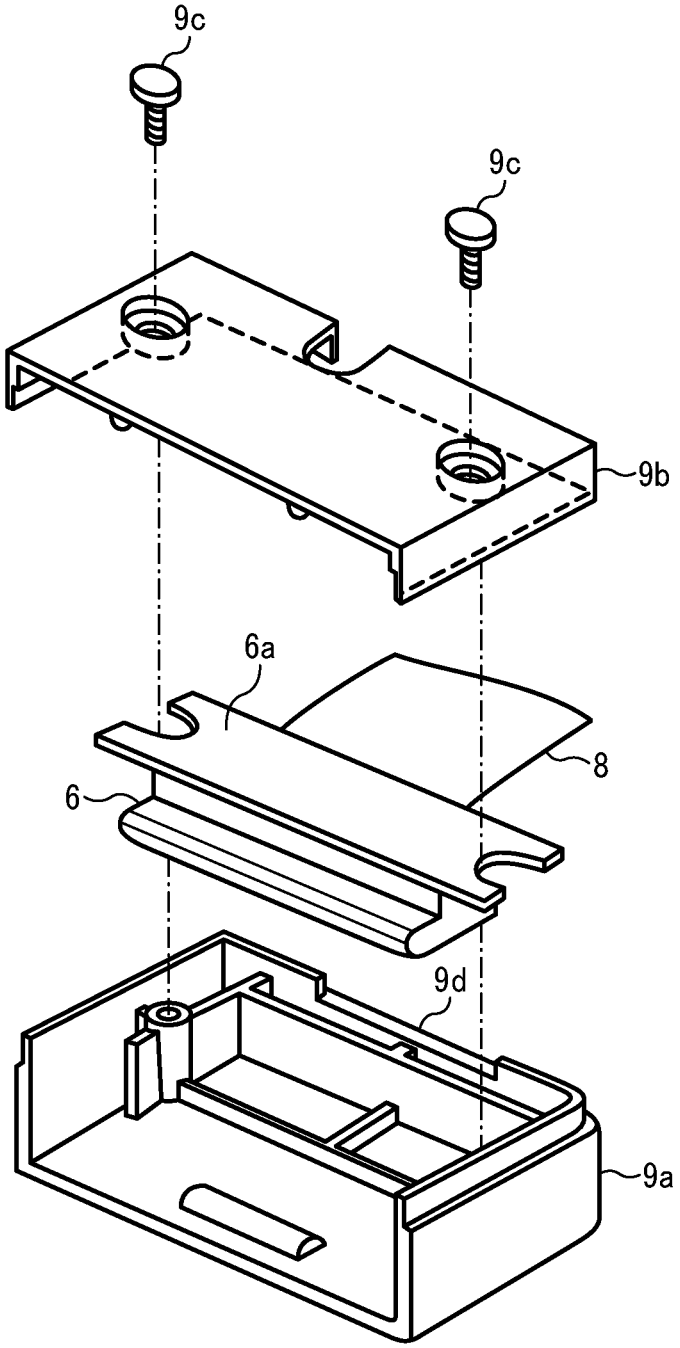
FIG. 12 is an exploded perspective view of a cover in the fourth embodiment.

Next, a fourth embodiment of the present disclosure is described with reference to FIGS. 11 and 12. FIG. 11 is a cross-sectional view of a portion around the electrical connector in the fourth embodiment. FIG. 12 is an exploded perspective view of a cover in the fourth embodiment.

Note that, in the following embodiment, the cable unit 2 corresponds to "relay cable 10" in the Japanese Patent Application No. 2016-026324. Similarly, the wiring member 8, the wiring-member-side connector 6, the head-side connector 5, the fitting portion 41, the head body 1, the discharger 3, and the cover 9 correspond to "FPC 11", "head-side connector 12", "head connector 438, "surrounding wall 438*a*", "liquid discharge device 430A", "liquid discharge head 434", and "cover 13", respectively.

In the present embodiment, the liquid discharge head includes the head body 1, the wiring member 8, the wiring-member-side connector 6, and the cover 9. The head body 1 discharges liquid. The wiring member 8 transmits signals to the head body 1. The wiring-member-side connector 6 is disposed at the wiring member 8 and is a connector to connect the head body 1 to the wiring member 8. The cover 9 is a protector to cover the head body 1 and the wiring-member-side connector 6.

The cover 4 of the head body 1 and the cover 9 of the cable unit 2 include the fitting portion 41 and the fitting portion 91, respectively, to engage each other. The leading end (opposing portion) 92 of the cover 9 in the fitting direction (indicated by arrow A in FIG. 11) opposes the step portion (opposing portion) 42 of the fitting portion 41.

In the present embodiment, the fitting portion 41 of the head body 1 is disposed at an inner circumferential side and the fitting portion 91 of the cover 9 is disposed at an outer circumferential side. Note that, in some embodiments, the fitting portion 41 of the head body 1 is disposed at the outer circumferential side and the fitting portion 91 of the cover 9 is disposed at the inner circumferential side.

The opposing portion 92 of the cover 9 and the opposing portion 42 of the fitting portion 41 preferably contact each other.

In the fitting direction (indicated by arrow A in FIG. 11) of the fitting portion 41 and the fitting portion 91, a connecting portion 56 of the wiring-member-side connector 6 and the head-side connector 5 is placed more backward (upward in FIG. 11) than the leading end (opposing portion) 92 of the fitting portion 91 of the cover 9 as the protector by a distance G.

Here, as illustrated in FIG. 12, in the cover 9, a cover part 9*a* and a cover part 9*b* are fitted with each other and secured by screws 9*c* for assembly. As illustrated in FIG. 11, a connector support plate 6*a* secured to the wiring-member-side connector 6 is sandwiched and supported by the cover part 9*a* and the cover part 9*b*.

However, the connector support plate 6*a* is supported by the cover 9 with a predetermined play so that the wiring-member-side connector 6 can be displaced relative to the cover 9 in consideration of the tolerances and assembly errors of components. Accordingly, even with the tolerances and assembly errors of components, the wiring-member-side connector 6 can be displaced relative to the cover 9 to properly connect the wiring-member-side connector 6 to the head-side connector 5 or the wiring-member-side connector 6 can be assembled with the cover 9 so that the wiring-member-side connector 6 is properly connected to the head-side connector 5.

To prevent foreign substances from entering the inside of the cover 9, an adhesive 9*e* as a sealer seals a clearance between the wiring member 8 and a cable port 9*d* to extend the wiring member 8 from the inside of the cover 9.

In the present embodiment, the fitting portion 91 of the cover 9 of the cable unit 2 is pushed toward the fitting portion 41 of the cover 4 to fit to the fitting portion 41 of the cover 4. Thus, the wiring-member-side connector 6 held by the cover 9 is pushed and fitted to the head-side connector 5. In the present embodiment, the connection of the wiring-member-side connector 6 and the head-side connector 5 is maintained by the fitting force of the fitting portion 91 of the cover 9 and the fitting portion 41 of the cover 4 and the fitting force of the wiring-member-side connector 6 and the head-side connector 5.

In the present embodiment, as described above, in the fitting direction (indicated by arrow A in FIG. 11) in which the fitting portion 91 is fitted to the fitting portion 41, the connecting portion 56 of the wiring-member-side connector 6 and the head-side connector 5 is placed more backward (upward) than the leading end 92 of the fitting portion 91 of the cover 9.

The connecting portion 56 is placed more upward than an upper end of the wiring-member-side connector 6 by a distance K.

When liquid enters the inside from between the opposing portion 42 of the fitting portion 41 and the opposing portion 92 of the fitting portion 91, such a configuration can reduce liquid from arriving at the connecting portion 56.

Figure 13:
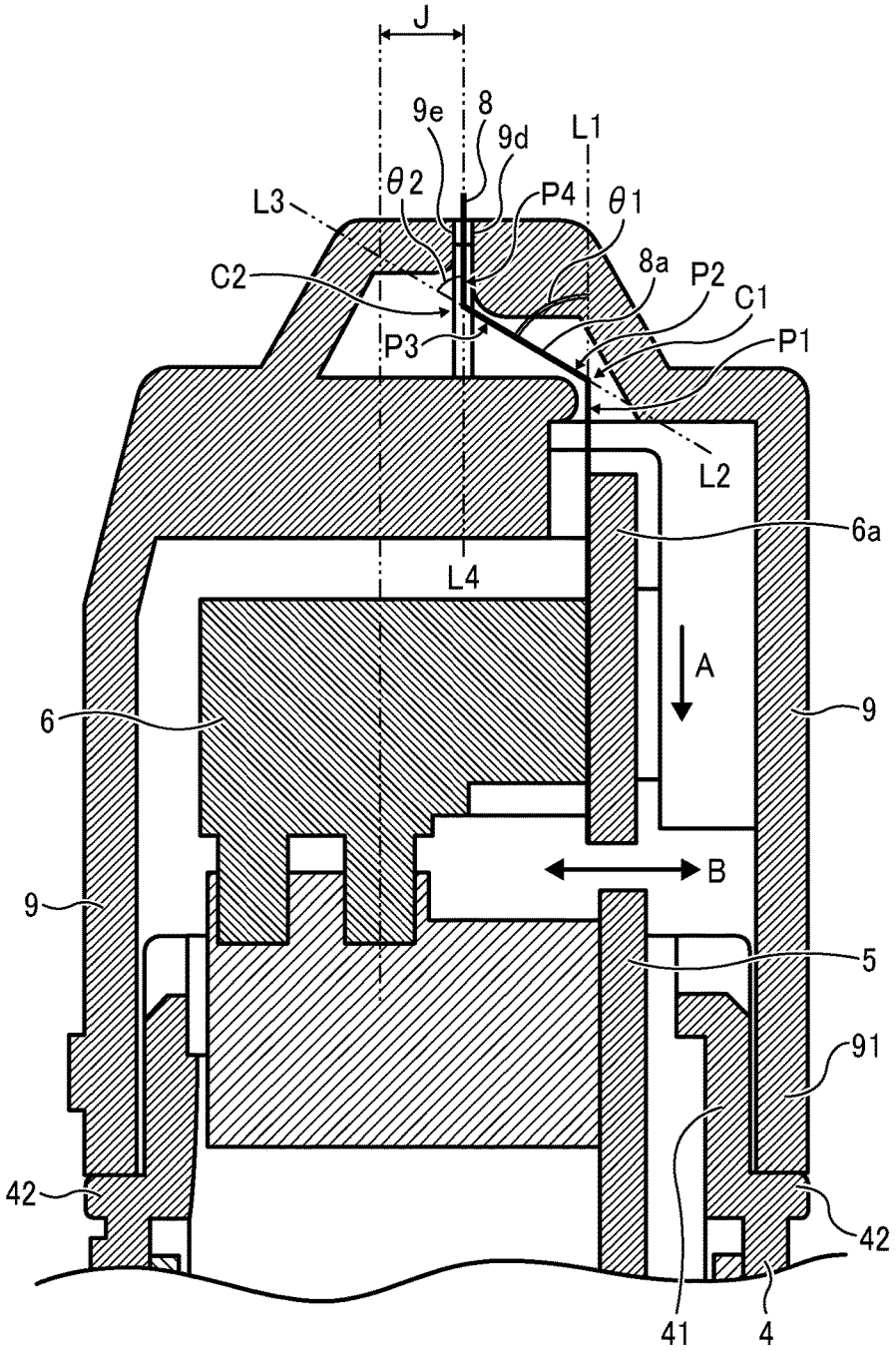
FIG. 13 is a cross-sectional view of a portion around an electrical connector in a fifth embodiment of the present disclosure.

Next, a fifth embodiment of the present disclosure is described with reference to FIG. 13. FIG. 13 is a cross-sectional view of a portion around the electrical connector in the fifth embodiment.

In the present embodiment, when the cover 9 of the wiring member 8 is pushed and fitted to the fitting portion 41 of the head body 1, the wiring-member-side connector 6 held by the cover 9 is pushed and fitted to the head-side connector 5.

The connection of the wiring-member-side connector 6 and the head-side connector 5 is maintained by the fitting force of the cover 9 and the fitting portion 41 and the fitting force of the wiring-member-side connector 6 and the head-side connector 5.

In the present embodiment, if the wiring-member-side connector 6 is displaceable relative to the cover 9, a large load may be applied to the wiring member 8 connected to the wiring-member-side connector 6 or the head body 1 connected to the head-side connector 5 by a pressing force or tensile force occurring when the wiring-member-side connector 6 is attached to or detached from the head-side connector 5 of the head body 1.

For example, as in the above-described fourth embodiment, in the configuration in which a wiring-member portion 8*a* disposed inside the cover 9 extends straight, when the pressing force or tensile force in attachment and detachment of the wiring-member-side connector 6 is transmitted to the wiring-member portion 8*a*, the pressing force or tensile force may not be relieved. Accordingly, a large load may be applied to the wiring member 8 or the head body 1.

As described in the fourth embodiment, to prevent foreign substances from entering the inside of the cover 9, the adhesive 9*e* as the sealer seals the clearance between the wiring member 8 and the cable port 9*d* to extend the wiring member 8 from the inside of the cover 9.

Accordingly, even if the pressing force or tensile force transmitted to the wiring-member portion 8*a* can be slightly relieved by slight extension and contraction of the wiring-member portion 8*a*, the pressing force or tensile force may not be sufficiently relieved. In addition, since a smaller size of the cover 9 is desired from constraints, such as the limitation of installation space (occupying space), a sufficient length of the wiring-member portion 8*a* inside the cover 9 may not obtained. Accordingly, the pressing force or tensile force may not be sufficiently relieved by only the extension and contraction of the wiring-member portion 8*a*.

In such a case, one effective way of relieving the load of the pressing force or tensile force in attachment and detachment of the wiring-member-side connector 6 is, for example, a way in which the wiring-member portion 8*a* inside the cover 9 includes a bent portion.

With such a configuration, a sufficient length of the wiring-member portion 8*a* inside the cover 9 can be easily obtained. When the pressing force or tensile force in attachment and detachment of the wiring-member-side connector 6 occurs, more force can be relieved by the extension and contraction of the wiring-member portion 8*a*. With the bent portion, the pressing force or tensile force in attachment and detachment of the wiring-member-side connector 6 can be relieved by movement of the bent portion.

Here, for example, for a configuration in which a portion of a wiring member, such as a flexible printed cable (FPC), inside the cover is in bent state, a space for accommodating the wiring member in the bent state is disposed inside the cover. In such a case, in consideration of the breaking of a wire, it is preferable to avoid sharp bending of the wiring member. Therefore, for example, in a configuration in which the bent angle of the bent portion is 180°, a sufficiently broader space is secured in an overlapping direction of the FPC as the wiring member than the thickness of the FPC. A sufficient space is also secured in the direction perpendicular to the overlapping direction of the FPC (the longitudinal direction of the FPC) to achieve bending of the FPC. However, as described above, a smaller size of the cover 9 is desired. In the above-described configuration in which the FPC is bent inside the cover, a relatively large size of the cover is needed and may not be employed as the cover 9.

Figure 16:
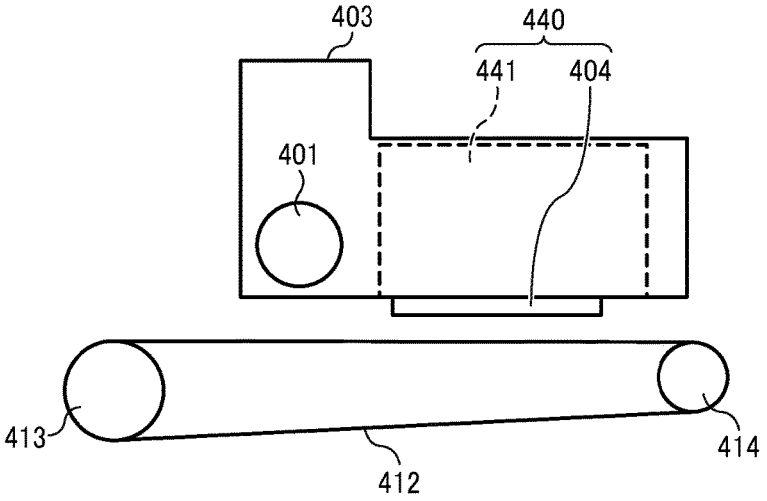
FIG. 16 is a side view of a portion of the liquid discharge apparatus of FIG. 15 including a liquid discharge device.

Hence, in the present embodiment, as illustrated in FIG. 16, the wiring-member portion 8*a* disposed inside the cover 9 includes bent portions C1 and C2.

With such a configuration, a sufficient length of the wiring-member portion 8*a* inside the cover 9 can be obtained. When the pressing force or tensile force in attachment and detachment of the wiring-member-side connector 6 occurs (in a vertical direction parallel to the direction indicated by arrow A or a horizontal direction indicated by arrow B), more force can be relieved by the extension and contraction of the wiring-member portion 8*a*. The pressing force or tensile force in attachment and detachment of the wiring-member-side connector 6 can be relieved by movement, such as opening and closing, of the bent portions C1 and C2. Such a configuration can reduce the load applied to, e.g., the wiring member 8 and the head body 1.

In addition, in the present embodiment, each of the bent portions C1 and C2 of the wiring-member portion 8*a* inside the cover 9 has a bent angle of 90° or smaller. With such a configuration, overlapping of the wiring member 8 does not occur, which is more advantageous in downsizing of the cover 9 than the above-described configuration in which the FPC is in bent state.

Note that the term "bent angle" used herein represents an angle formed by a direction in which the wiring member 8 extends immediately before the start of bending and a direction in which the wiring member 8 extends immediately before the end of bending.

Accordingly, the bent angle of the bent portion C1 in the present embodiment, as illustrated in FIG. 13, is an angle θ1 formed by an extending direction L1 of the wiring member 8 at a point P1 immediately before the start of bending and an extending direction L2 of the wiring member 8 at a point P2 immediately before the end of bending.

Similarly, the bent angle of the bent portion C2 in the present embodiment, as illustrated in FIG. 13, is an angle θ2 formed by an extending direction L3 of the wiring member 8 at a point P3 immediately before the start of bending and an extending direction L4 of the wiring member 8 at a point P4 immediately before the end of bending.

In the present embodiment, to obtain the bent portions C1 and C2 of the wiring-member portion 8*a* inside the cover 9, as illustrated in FIG. 13, a configuration is employed in which an upper portion of the cover 9 is raised only around the cable port 9*d*. Some surplus space is likely to be obtained around the wiring-member portion 8*a* immediately after the wiring member 8 extends out the cable port 9*d*. In the present embodiment, utilizing the surplus space, the upper portion of the cover 9 is raised. Using the internal space of the raised portion, the bent portions C1 and C2 of the wiring-member portion 8*a* inside the cover 9 are obtained.

In the present embodiment, as illustrated in FIG. 13, the cable port 9*d* to extend out the wiring member 8 from the inside of the cover 9 is disposed at a position away from an extension line (indicated by L1 in FIG. 13) extending from the wiring-member-side connector 6 to a direction in which the wiring-member-side connector 6 is attached to and detached from the head-side connector 5 as a connection target.

The demand for downsizing of the cover 9 imposes a limitation on the amount in which the upper portion of the cover 9 is raised. Therefore, a configuration in which the cable port 9*d* is disposed on the extension line L1 makes difficult to bend and dispose the wiring-member portion 8*a* inside the cover 9. Accordingly, the wiring member 8 is disposed straight inside the cover 9.

By contrast, for the configuration in which the cable port 9*d* is disposed away from the extension line L1, the wiring-member portion 8*a* can be disposed inside the cover 9 in a state in which the wiring-member portion 8*a* is bent by a sufficient bent angle.

Accordingly, while reducing an increase in the size of the cover 9, the pressing force or tensile force occurring in attachment and detachment of the wiring-member-side connector 6 can be sufficiently relieved, thus reducing the load applied to the wiring member 8 and the head body 1.

As described above, the cable port 9*d* of the cover 9 to extend out the wiring member 8 from the inside of the cover 9 is disposed at a position not overlapping the connecting portion of the wiring-member-side connector 6 and the head-side connector 5 (the head body) in the direction (indicated by arrow B) perpendicular to the fitting direction (a position away from the connecting portion by a distance J in FIG. 13).

Even if the cable port 9*d* of the cover 9 is not sealed, such a configuration can prevent liquid having entered from the cable port 9*d* from moving along, e.g., the wiring member 8 to the connecting portion of the wiring-member-side connector 6 and the head-side connector 5 (the head body).

In the present embodiment, the wiring member 8 has at least two bent portions (the bent portions C1 and C2). Of the wiring member 8 (the wiring member), a surface (surface along the extension line L1) contacting the wiring-member-side connector 6 (the connecting portion) is disposed parallel to a surface (surface along a straight line L4) opposing the cable port 9*d*.

Such a configuration can achieve both space saving and load reduction.

Figure 14:
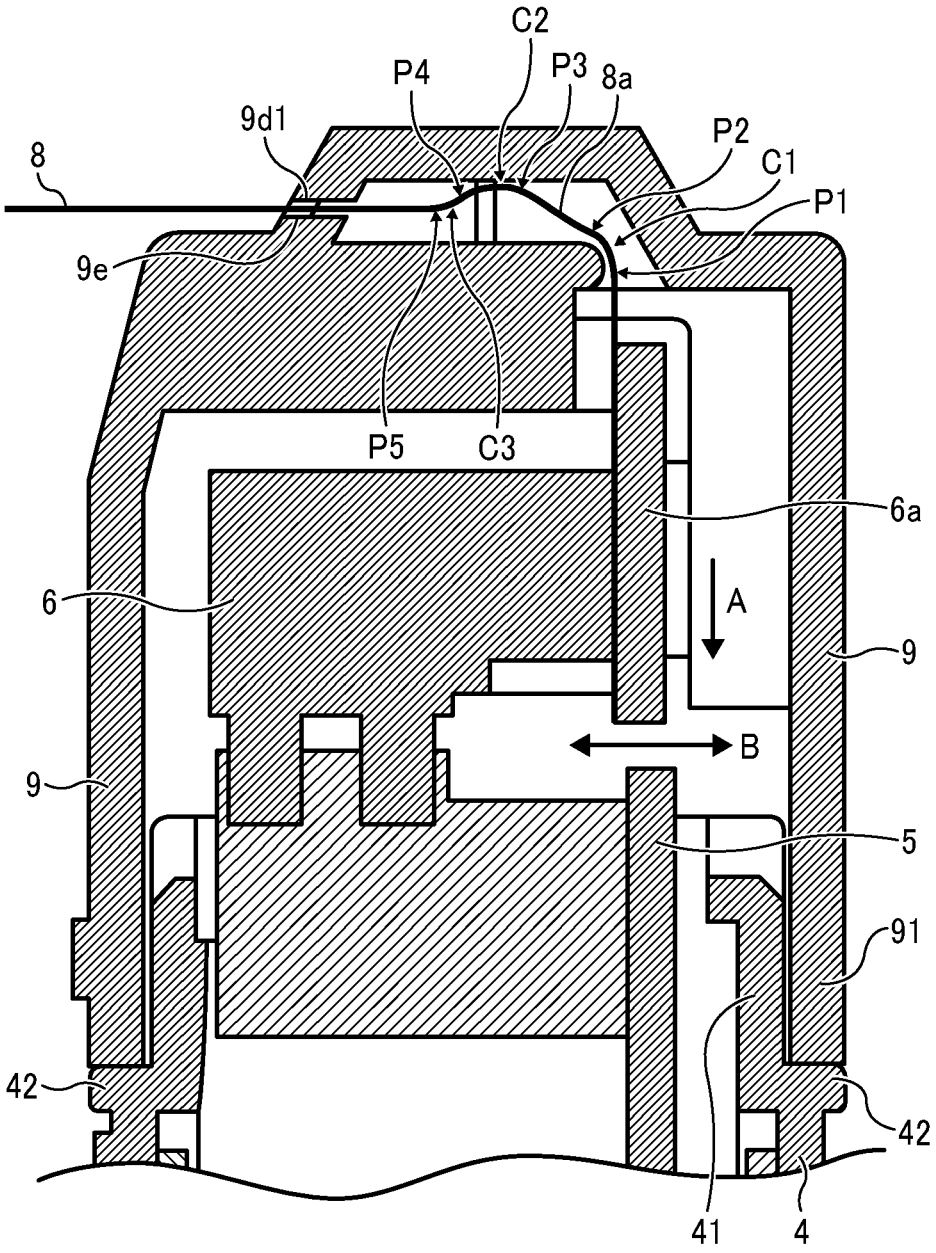
FIG. 14 is a cross-sectional view of a portion around an electrical connector in a sixth embodiment of the present disclosure.

Next, a sixth embodiment of the present disclosure is described with reference to FIG. 14. FIG. 14 is a cross-sectional view of a portion around the electrical connector in the sixth embodiment.

In the above-described fifth embodiment, the cable port 9*d* is disposed so that the direction in which the wiring member 8 extends out the inside of the cover 9 is parallel to the direction of attachment and detachment of the wiring-member-side connector 6. However, embodiments of the present disclosure are not limited to such a configuration.

As in the present embodiment, the cable port 9*d* may be disposed so that the direction in which the wiring member 8 extends out the inside of the cover 9 is perpendicular to the direction of attachment and detachment of the wiring-member-side connector 6.

In the above-described fifth embodiment, the wiring-member portion 8*a* inside the cover 9 has the two bent portions C1 and C2. However, in some embodiments, the wiring-member portion 8*a* inside the cover 9 may have three or more bent portions. For example, as in the present embodiment, the wiring-member portion 8*a* inside the cover 9 may have three bent portions C1, C2, and C3. For example, in FIG. 14, P1 represents a point immediately before the start of bending of the bent portion C1 and P2 represents a point immediately before the end of bending of the bent portion C1. Similarly, P3 represents a point immediately before the start of bending of the bent portion C2 and P4 represents a point immediately before the end of bending of the bent portion C2. P4 also represents a point immediately before the start of bending of the bent portion C3 and P5 represents a point immediately before the end of bending of the bent portion C3.

In the present embodiment, a port 9*d*1 of the cover 9 is disposed in the direction (indicated by arrow B) perpendicular to the fitting direction (indicated by arrow A), which is the same as the direction of attachment and detachment of the wiring-member-side connector 6.

Such a configuration can prevent entry of liquid. In other words, in a case in which the port 9*d* is open upward as in the above-described fifth embodiment, liquid having entered the inside of the cover 9 flows downward. By contrast, in the configuration in which, like the port 9*d*1, the port is open in the (horizontal) direction perpendicular to the vertical direction, liquid having entered from the port 9*d*1 is unlikely to move into the inside of the cover 9.

In addition, in a case in which a plurality of liquid discharge heads is arrayed, the wiring member (cable) can be bound in one without sharply bending the wiring member (cable), thus allowing space saving and load reduction.

The configurations of the above-described fifth embodiment and sixth embodiment regarding the layout of the wiring member are examples. Aspects of the present disclosure have, for example, the following advantages.

Aspect A

A cable, such as the cable unit 2, includes a flexible wiring member, such as the wiring member 8, connected to a connection target, such as the head-side connector 5; a connector, such as the wiring-member-side connector 6, disposed at one end of the wiring member and detachably connected to the connection target; and a cover, such as the cover 9, to cover the connector. In the cable, a portion of the wiring member, such as the wiring-member portion 8*a*, disposed inside the cover includes at least one bent portion, such as the bent portions C1, C2, and C3. Each of the at least one bent portion has a bent angle of 90° or smaller.

According to Aspect A, when a load of the pressing force or tensile force occurs in attachment and detachment of the connector, the load can be relieved to the portion of the wiring member disposed inside the cover by action (e.g., closing or opening) of the at least one bent portion. The bent portion(s) allows setting of a sufficient length of the portion of the wiring member inside the cover.

Such a configuration can increase the amount in which the load can be relieved by the portion of the wiring member inside the cover. As a result, according to Aspect A, the load applied to the cable and the connection target can be reduced.

On the other hand, even when the flexible wiring member is used, it is preferable to avoid sharp bending of the wiring member in consideration of, e.g., the breaking of a wire. Therefore, in the configuration in which a cable is disposed in bent state inside the cover (in other words, in the configuration in which the bent angle of the bent portion is 180°, as described above, a sufficiently broad space is preferably disposed in the overlapping direction of the wiring member or the longitudinal direction of the wiring member, thus resulting in an increase in size of the cover.

By contrast, in Aspect A, since the bent angle of each of the at least one bent portion is equal to or smaller than 90°, the overlapping of the wiring member does not occur. Such a configuration can reduce the size of the space in the overlapping direction of the wiring member or the longitudinal direction of the wiring member, thus restricting an increase in size of the cover.

Aspect B

In the above-described Aspect A, a port, such as the port 9*d*, to extend the wiring member out the inside of the cover is disposed at a position away from an extension line (e.g., the extension line indicated by L1 in FIG. 13) extending from the connector to a direction in which the connector is attached to or detached from as the connection target.

As described above, such a configuration facilitates setting of the bent portion having a sufficient bent angle without increasing the size of the cover. As a result, a sufficient movement (e.g., opening and closing) of the bent portion to relieve the load can be achieved, and a sufficient length of a portion of the cable can be obtained to allow sufficient extension and contraction to relieve the load.

Aspect C

In Aspect A and B, a clearance between the port, such as the port 9*d*, to extend the wiring member out the inside of the cover and the wiring member is sealed with a sealer, such as the adhesive 9*e*.

Such a configuration can prevent foreign substance introduced from the clearance from adhering to the connector. When the clearance is sealed with the sealer, only the portion of the wiring member disposed inside the cover is usable to relieve the load. Accordingly, the load is likely to be applied to the wiring member and the connection target. However, as described above, according to the present Aspect C, the load can be relieved by only the portion of the wiring member inside the cover.

Aspect D

A liquid discharge head includes a head body and the wiring member according to any of the above-described Aspects A to C.

According to Aspect D, the liquid discharge head can relive the load of the pressing force or tensile force occurring in attachment and detachment of the connector without increasing the size of the cover.

Aspect E

A liquid discharge apparatus, such as an inkjet printer, includes a cable connector, such as the head-side connector 5, connected to a cable, such as the cable unit 2; the cable, such as the cable unit 2, detachably connected to the cable connector; a liquid discharge head to discharge liquid, such as ink, from discharge orifices, such as nozzles, according to drive signals transmitted via the cable. The cable is a cable according to any of the above-described Aspects A to C.

According to Aspect E, the liquid discharge apparatus can relive the load of the pressing force or tensile force occurring in attachment and detachment of the connector without increasing the size of the cover.

Figure 15:
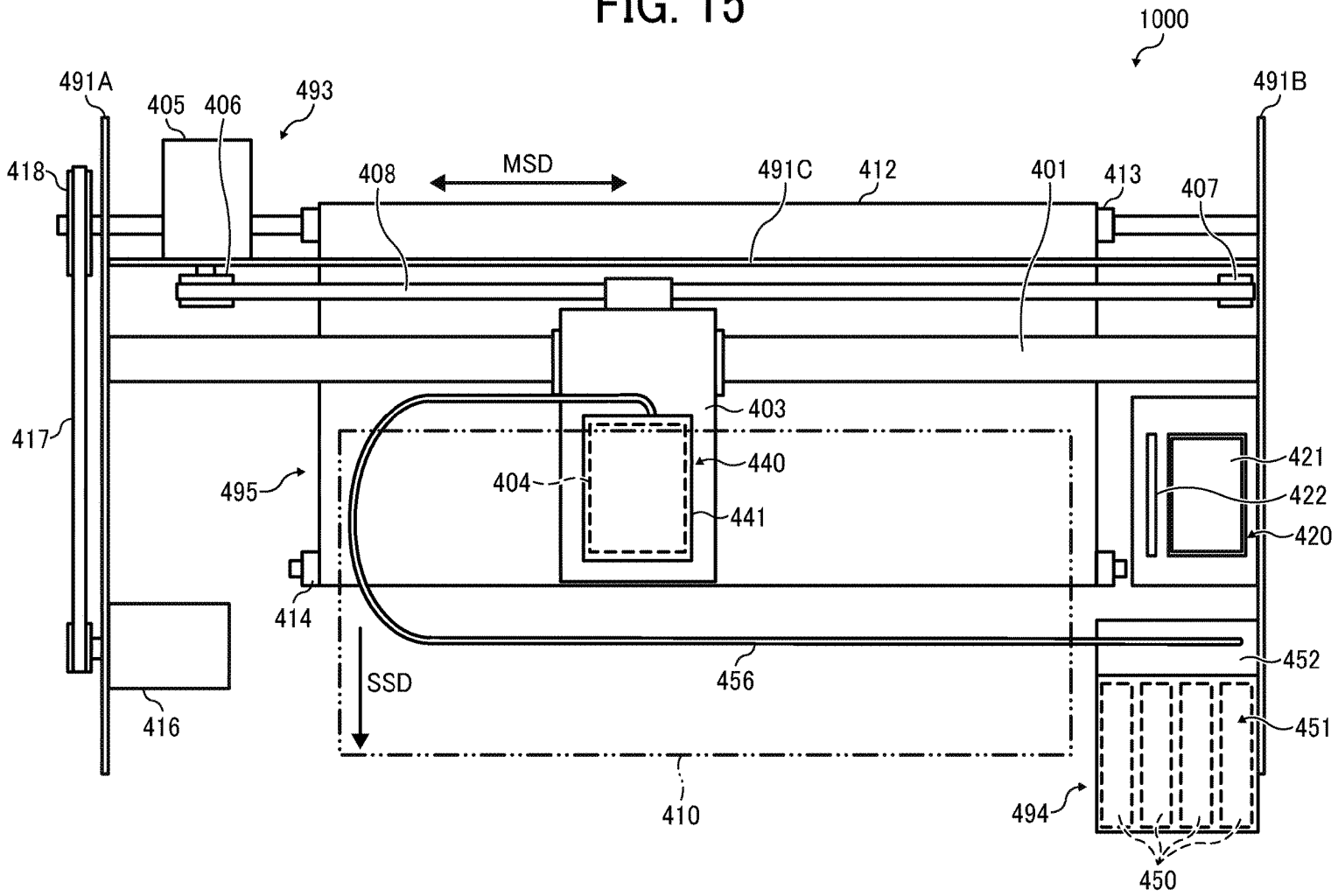
FIG. 15 is a plan view of a portion of a liquid discharge apparatus according to an embodiment of the present disclosure.

Next, a liquid discharge apparatus according to an embodiment of the present disclosure is described with reference to FIGS. 15 and 16. FIG. 15 is a plan view of a portion of the liquid discharge apparatus according to an embodiment of the present disclosure. FIG. 16 is a side view of a portion of the liquid discharge apparatus of FIG. 15.

A liquid discharge apparatus 1000 according to the present embodiment is a serial-type apparatus in which a main scan moving unit 493 reciprocally moves a carriage 403 in a main scanning direction indicated by arrow MSD in FIG. 15. The main scan moving unit 493 includes, e.g., a guide 401, a main scanning motor 405, and a timing belt 408. The guide 401 is laterally bridged between a left side plate 491A and a right side plate 491B and supports the carriage 403 so that the carriage 403 is movable along the guide 401. The main scanning motor 405 reciprocally moves the carriage 403 in the main scanning direction MSD via the timing belt 408 laterally bridged between a drive pulley 406 and a driven pulley 407.

The carriage 403 mounts a liquid discharge device 440 in which the liquid discharge head 404 and a head tank 441 are integrated as a single unit. The liquid discharge head 404 of the liquid discharge device 440 discharges ink droplets of respective colors of yellow (Y), cyan (C), magenta (M), and black (K). The liquid discharge head 404 includes nozzle rows, each including a plurality of nozzles 4 arrayed in row in a sub-scanning direction, which is indicated by arrow SSD in FIG. 18, perpendicular to the main scanning direction MSD. The liquid discharge head 404 is mounted to the carriage 403 so that ink droplets are discharged downward.

The liquid stored outside the liquid discharge head 404 is supplied to the liquid discharge head 404 via a supply unit 494 that supplies the liquid from a liquid cartridge 450 to the head tank 441.

The supply unit 494 includes, e.g., a cartridge holder 451 as a mount part to mount liquid cartridges 450, a tube 456, and a liquid feed unit 452 including a liquid feed pump. The liquid cartridge 450 is detachably attached to the cartridge holder 451. The liquid is supplied to the head tank 441 by the liquid feed unit 452 via the tube 456 from the liquid cartridges 450.

The liquid discharge apparatus 1000 includes a conveyance unit 495 to convey a sheet 410. The conveyance unit 495 includes a conveyance belt 412 as a conveyor and a sub-scanning motor 416 to drive the conveyance belt 412.

The conveyance belt 412 electrostatically attracts the sheet 410 and conveys the sheet 410 at a position facing the liquid discharge head 404. The conveyance belt 412 is an endless belt and is stretched between a conveyance roller 413 and a tension roller 414. The sheet 410 is attracted to the conveyance belt 412 by electrostatic force or air aspiration.

The conveyance roller 413 is driven and rotated by the sub-scanning motor 416 via a timing belt 417 and a timing pulley 418, so that the conveyance belt 412 circulates in the sub-scanning direction SSD.

At one side in the main scanning direction MSD of the carriage 403, a maintenance unit 420 to maintain and recover the liquid discharge head 404 in good condition is disposed on a lateral side of the conveyance belt 412.

The maintenance unit 420 includes, for example, a cap 421 to cap a nozzle face (i.e., a face on which the nozzles are formed) of the liquid discharge head 404 and a wiper 422 to wipe the nozzle face.

The main scan moving unit 493, the supply unit 494, the maintenance unit 420, and the conveyance unit 495 are mounted to a housing that includes the left side plate 491A, the right side plate 491B, and a rear side plate 491C.

In the liquid discharge apparatus 1000 thus configured, the sheet 410 is conveyed on and attracted to the conveyance belt 412 and is conveyed in the sub-scanning direction SSD by the cyclic rotation of the conveyance belt 412.

The liquid discharge head 404 is driven in response to image signals while the carriage 403 moves in the main scanning direction MSD, to discharge liquid to the sheet 410 stopped, thus forming an image on the sheet 410.

As described above, the liquid discharge apparatus 1000 includes the liquid discharge head 404 according to an embodiment of the present disclosure, thus allowing stable formation of high quality images.

Figure 17:
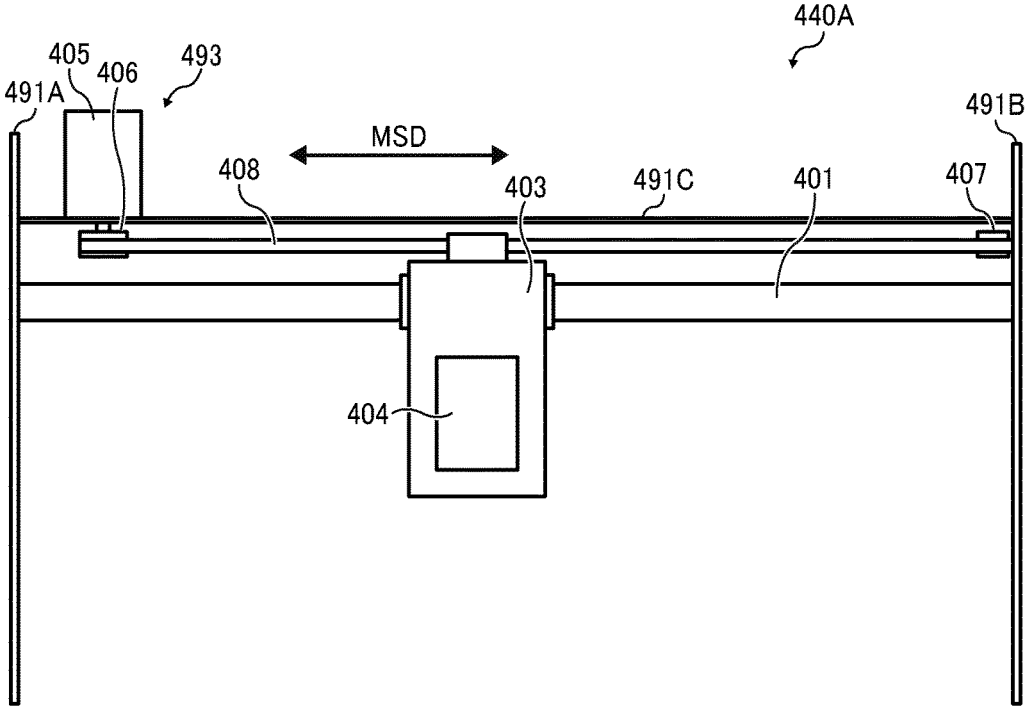
FIG. 17 is a plan view of a portion of another example of the liquid discharge device.

Next, another example of the liquid discharge device according to an embodiment of the present disclosure is described with reference to FIG. 17. FIG. 17 is a plan view of a portion of another example of the liquid discharge device (liquid discharge device 440A).

The liquid discharge device 440A includes the housing, the main scan moving unit 493, the carriage 403, and the liquid discharge head 404 among components of the liquid discharge apparatus 1000. The left side plate 491A, the right side plate 491B, and the rear side plate 491C constitute the housing.

Note that, in the liquid discharge device 440A, at least one of the maintenance unit 420 and the supply unit 494 may be mounted on, for example, the right side plate 491B.

Figure 18:
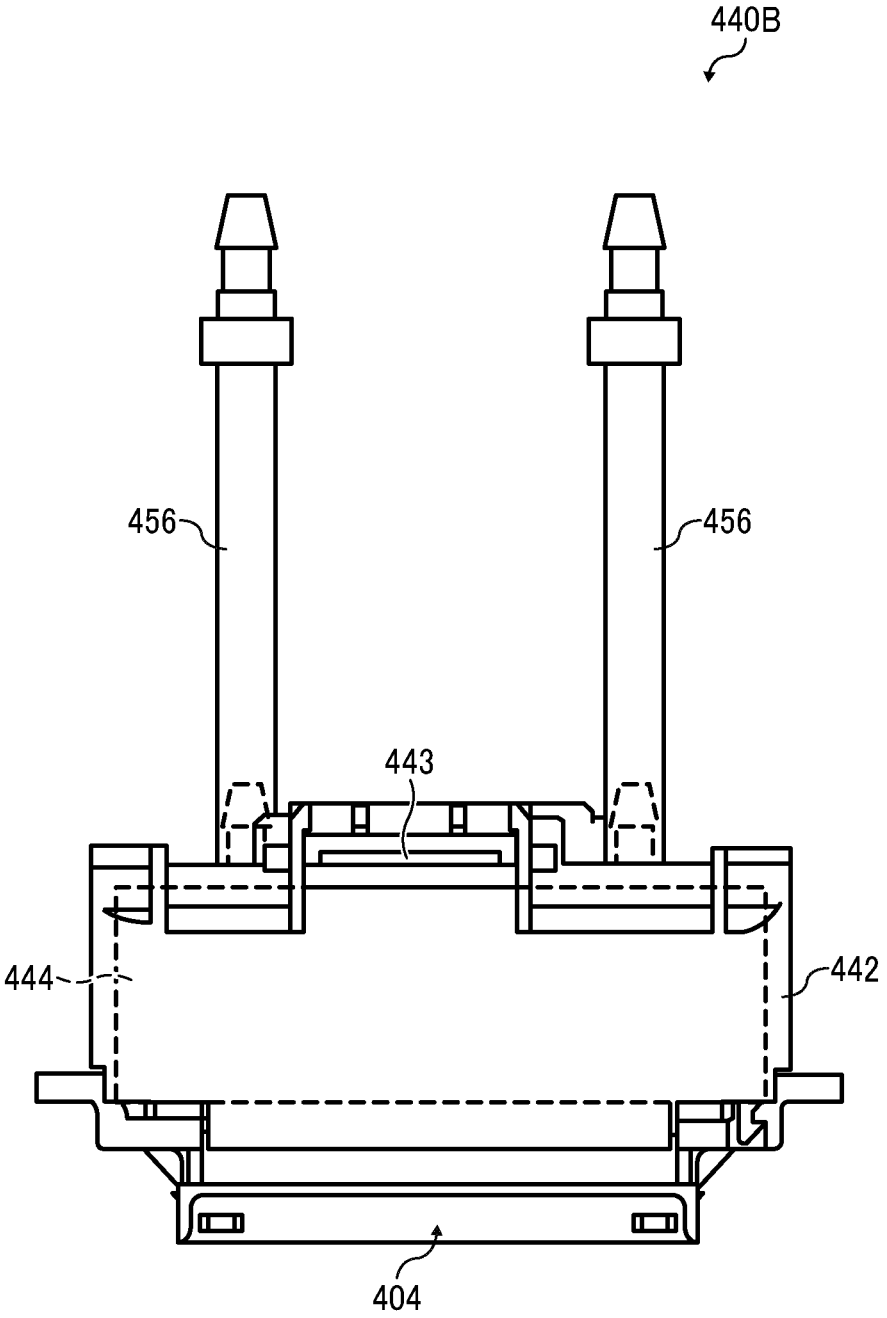
FIG. 18 is a front view of still another example of the liquid discharge device.

Next, still another example of the liquid discharge device according to an embodiment of the present disclosure is described with reference to FIG. 18. FIG. 18 is a front view of still another example of the liquid discharge device (liquid discharge device 440B).

The liquid discharge device 440B includes the liquid discharge head 404 to which a channel part 444 is mounted, and the tube 456 connected to the channel part 444.

Further, the channel part 444 is disposed inside a cover 442. Instead of the channel part 444, the liquid discharge device 440B may include the head tank 441. A connector 443 to electrically connect the liquid discharge head 404 to a power source is disposed above the channel part 444.

Figure 19:
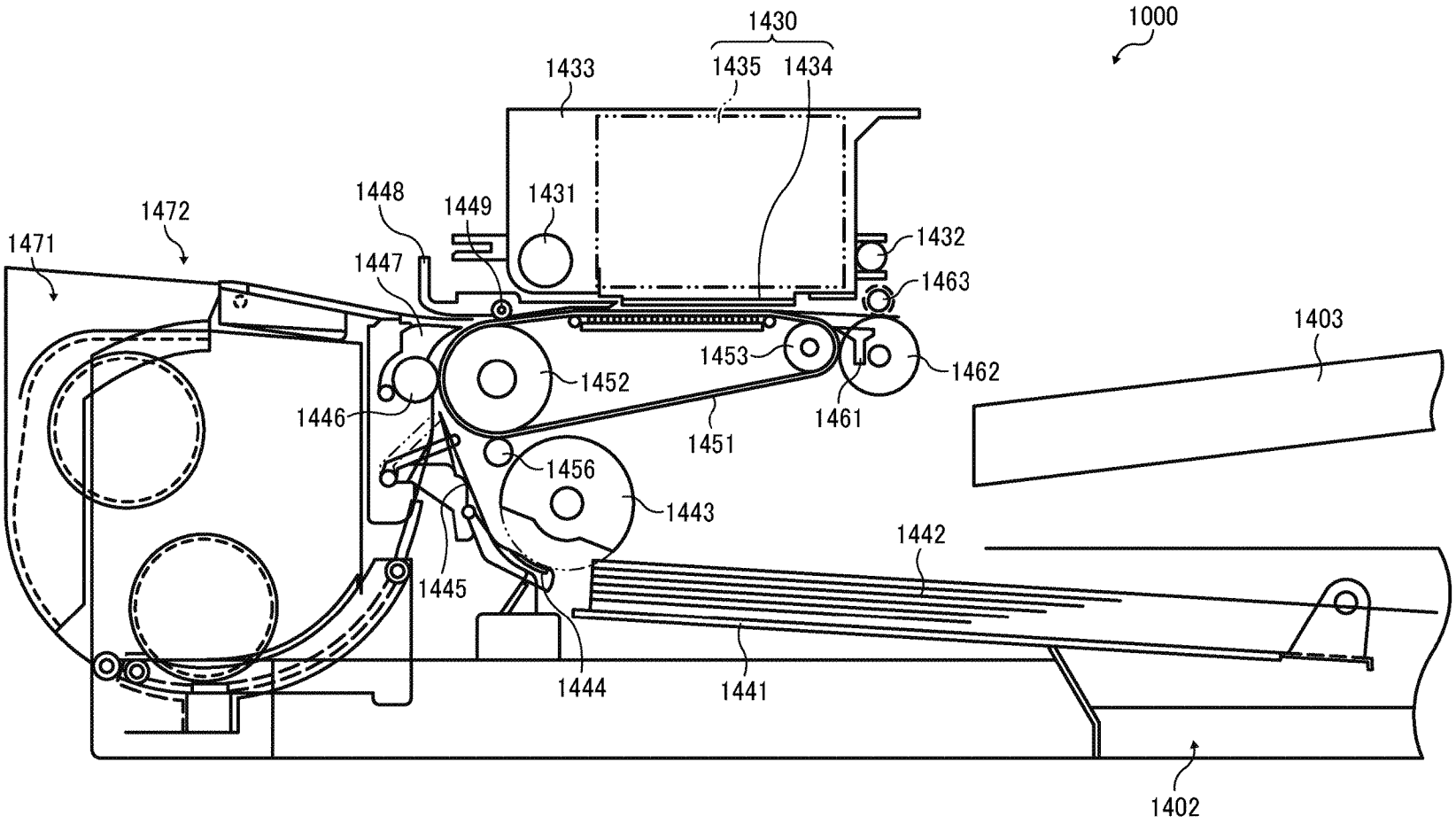
FIG. 19 is a side view of another example of a mechanical section of the liquid discharge apparatus.
Figure 20:
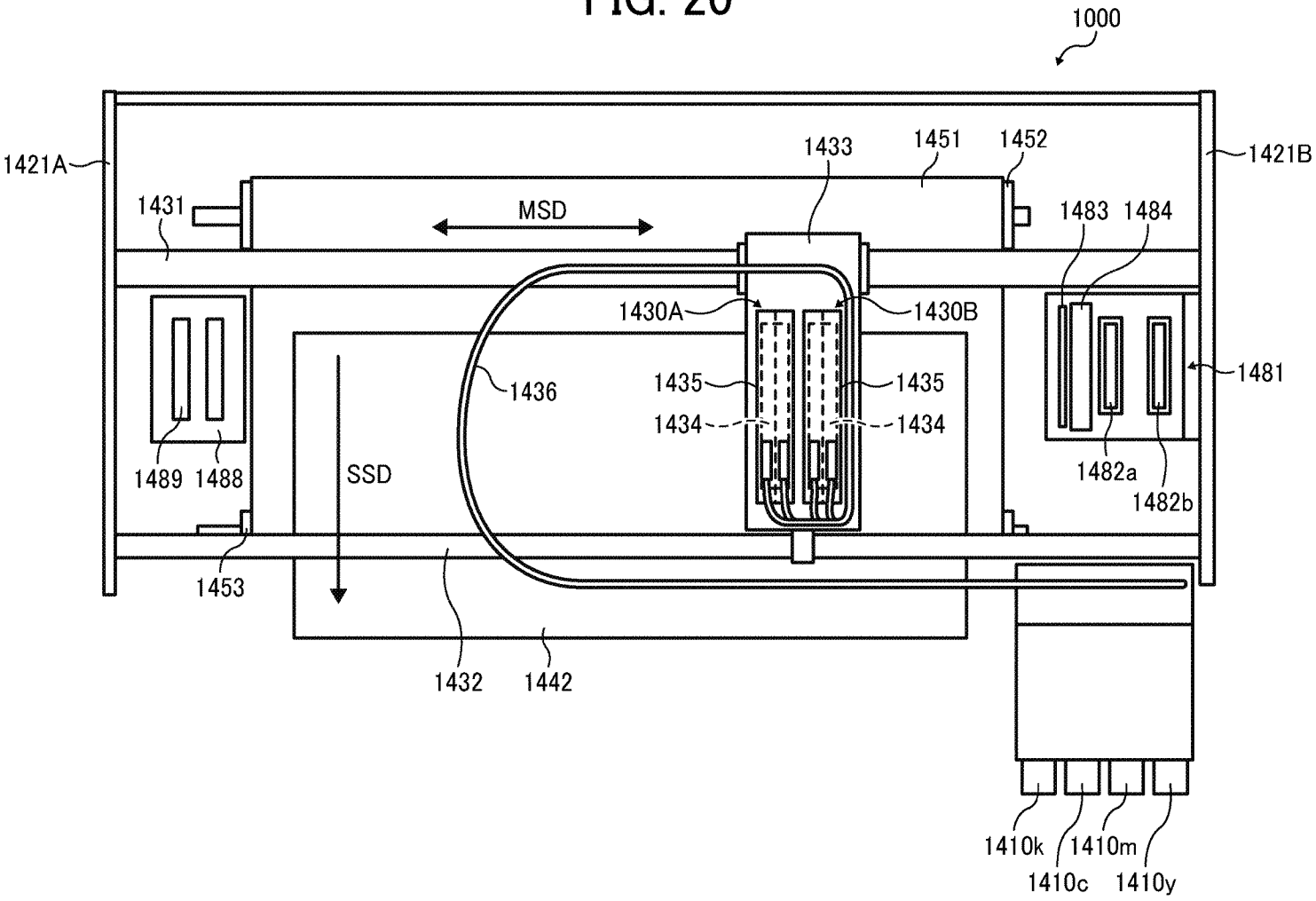
FIG. 20 is a plan view of a portion of the mechanical section of FIG. 19.

Next, an inkjet printer (hereinafter, simply referred to as "printer") being an inkjet recording apparatus as another example of the liquid discharge apparatus illustrated is described with reference to FIGS. 19 and 20. FIG. 19 is a side view of a mechanical section of the liquid discharge apparatus according to an embodiment of the present disclosure. FIG. 20 is a plan view of a portion of the mechanical section of the liquid discharge apparatus of FIG. 19.

The liquid discharge apparatus 1000 according to the present embodiment is a serial-type inkjet recording apparatus. A carriage 1433 is supported by a main guide rod 1431 and a sub guide rod 1432 so as to be reciprocally movable in a direction (main scanning direction) indicated by arrow MSD in FIG. 20. The main guide rod 1431 and the sub guide rod 1432 are laterally bridged between a left side plate 1421A and a right side plate 1421B.

Two liquid discharge units 1430 (1430A and 1430B) are mounted on the carriage 1433. Each of the liquid discharge units 1430 includes an integrated unit of a liquid discharge head 1434 as a liquid discharger and a head tank 1435 as a sub tank to supply ink to the liquid discharge head 1434. The liquid discharge head 1434 includes nozzle rows having multiple nozzles (discharge orifices). The nozzle rows are arranged in the sub-scanning direction (longitudinal direction of the liquid discharge head), which is indicated by arrow SSD in FIG. 20, perpendicular to the main scanning direction MSD with the liquid discharge direction downward.

The liquid discharge head 1434 includes, for example, two nozzle rows. For example, one nozzle row of the liquid discharge head 1434 of the liquid discharge unit 1430A discharges ink of black (K) and the other nozzle row discharges ink of cyan (C). For example, one nozzle row of the liquid discharge head 1434 of the liquid discharge unit 1430B discharges ink of magenta (M) and the other nozzle row discharges ink of yellow (Y). In the present embodiment, ink of four colors is discharge with two liquid discharge heads. In some embodiments, four nozzle rows may be arrayed in a single liquid discharge head to discharge ink of four colors.

Main tanks 1410*k*, 1410*c*, 1410*m*, and 1410*y* as liquid cartridges of four colors are detachably attached to a cartridge holder 1404 mounted at an apparatus body. A liquid feed unit 1424 including a liquid feed pump sends ink of four colors from the main tanks 1410 of the four colors to the head tanks 1435 of the liquid discharge unit 1430A and the liquid discharge unit 1430B via supply tubes 1436 of the four colors.

The liquid discharge apparatus 1000 further includes a sheet feeder to feed sheets 1442, which are discharge targets, stacked on a sheet stacker 1441 of a sheet feed tray 1402. The sheet feeder further includes a sheet feed roller 1443 and a separation pad 1444. The sheet feed roller 1443 separates and feeds the sheets 1442 sheet by sheet from the sheet stacker 1441. The separation pad 1444 is disposed opposing the sheet feed roller 1443. The liquid discharge apparatus 1000 includes a guide 1445, a counter roller 1446, a conveyance guide 1447, and a pressing member 1448 having a leading-end pressing roller 1449, to convey and guide the sheet 1442 fed from the sheet feeder. The liquid discharge apparatus 1000 includes a conveyance belt 1451 as a conveyor to attract and convey the sheet 1442 at a position facing the liquid discharge head 1434 of the liquid discharge unit 1430.

The conveyance belt 1451 is an endless belt looped around a conveyance roller 1452 and a tension roller 1453 to circulate in a belt conveyance direction (sub-scanning direction) indicated by arrow SSD in FIG. 20. The conveyance belt 1451 is an electrostatic conveyance belt charged by a charging roller 1456 as a charger. However, in some embodiments, the conveyance belt 1451 may be a conveyance belt to attract the sheet 1442 by air suction. Alternatively, the conveyor is not limited to the conveyance belt and may be, for example, a conveyance roller.

A stripping claw 1461 to separate the sheet 1442 from the conveyor belt 1451, a sheet ejection roller 1462, and a sheet ejection roller 1463 are situated downstream of the tension roller 1453 around which the conveyor belt is stretched. Also, a sheet ejection tray 1403 is located below the sheet ejection roller 1462. A duplex unit 1471 is removably attached to a rear portion of the apparatus body. When the conveyance belt 1451 rotates in reverse to return the sheet 1442, the duplex unit 1471 receives the sheet 1442. Then the duplex unit 1471 reverses and feeds the sheet 1442 to a nipping portion between the counter roller 1446 and the conveyance belt 1451. A bypass tray 1472 is disposed at an upper face of the duplex unit 1471. A maintenance unit (maintenance and recovery device) 1481 is disposed in a non-image forming area at one side in the main scanning direction MSD of the carriage 1433 to maintain and recover the state of the nozzles of the liquid discharge heads 1434 in the liquid discharge units 1430A and 1430B.

The maintenance unit 1481 includes caps 1482*a* and 1482*b* to cap the nozzle faces of the liquid discharge heads 1434. The maintenance unit 1481 also includes a blade 1483 to wipe the nozzle faces. The maintenance unit 1481 further includes, e.g., a dummy discharge receptacle 1484 to receive ink discharged in dummy discharge in which ink not contributing to image formation is discharged to discharge thickened ink. In a non-image forming area at the other end in the main scanning direction MSD of the carriage 1433, the liquid discharge apparatus 1000 includes a dummy discharge receptacle 1488 to receive ink discharged by dummy discharge during image formation. The dummy discharge receptacle 1488 includes openings 1489 along the nozzle array direction of the liquid discharge head 1434 in which nozzles are arrayed in row.

In the liquid discharge apparatus 1000, the sheet 1442 is separated and fed substantially vertically upward from the sheet feed tray 1402 one by one, guided by the guide 1445, and conveyed while being nipped between the conveyance belt 1452 and the counter roller 1446. The sheet 1442 is guided by the conveyance guide 1447 and pressed against the conveyance belt 1451 by the leading-end pressing roller 1449. Thus, the conveyance direction of the sheet 1442 is turned substantially 90°. When the sheet 1442 is fed onto the conveyance belt 1451 charged, the sheet 1442 is attracted onto the conveyance belt 1451 and conveyed in the sub-scanning direction SSD by circulation of the conveyance belt 1451. By driving the liquid discharge heads 1434 of the liquid discharge units 1430A and 1430B in response to image signals while moving the carriage 1433, ink is discharged onto the sheet 1442 stopped, to record one line of a desired image. Then, the sheet 1442 is fed by a predetermined distance, and another line is recorded. Receiving a recording end signal or a signal indicating that the rear end of the sheet 1442 has arrived at the recording area, the recording operation finishes and the sheet 1442 is output to the sheet ejection tray 1403.

In the present disclosure, discharged liquid is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a thermal resistor, and an electrostatic actuator including a diaphragm and opposed electrodes.

The liquid discharge device is an integrated unit including the liquid discharge head and a functional part(s) or unit(s), and is an assembly of parts relating to liquid discharge. For example, the liquid discharge device may be a combination of the liquid discharge head with at least one of the head tank, the carriage, the supply unit, the maintenance unit, and the main scan moving unit.

Here, examples of the integrated unit include a combination in which the liquid discharge head and a functional part(s) are secured to each other through, e.g., fastening, bonding, or engaging, and a combination in which one of the liquid discharge head and a functional part(s) is movably held by another. The liquid discharge head may be detachably attached to the functional part(s) or unit(s) s each other.

For example, the liquid discharge head and a head tank are integrated as the liquid discharge device. The liquid discharge head and the head tank may be connected each other via, e.g., a tube to integrally form the liquid discharge device. Here, a unit including a filter may further be added to a portion between the head tank and the liquid discharge head.

In another example, the liquid discharge device may be an integrated unit in which a liquid discharge head is integrated with a carriage.

In still another example, the liquid discharge device may be the liquid discharge head movably held by a guide that forms part of a main-scanning moving device, so that the liquid discharge head and the main-scanning moving device are integrated as a single unit. The liquid discharge device may include the liquid discharge head, the carriage, and the main scan moving unit that are integrated as a single unit.

In another example, the cap that forms part of the maintenance unit is secured to the carriage mounting the liquid discharge head so that the liquid discharge head, the carriage, and the maintenance unit are integrated as a single unit to form the liquid discharge device.

Further, in another example, the liquid discharge device includes tubes connected to the head tank or the channel member mounted on the liquid discharge head so that the liquid discharge head and the supply assembly are integrated as a single unit. Liquid is supplied from a liquid reservoir source to the liquid discharge head.

The main-scan moving unit may be a guide only. The supply unit may be a tube(s) only or a loading unit only.

The term "liquid discharge apparatus" used herein also represents an apparatus including the liquid discharge head or the liquid discharge device to discharge liquid by driving the liquid discharge head. The liquid discharge apparatus may be, for example, an apparatus capable of discharging liquid to a material to which liquid can adhere or an apparatus to discharge liquid toward gas or into liquid.

The liquid discharge apparatus may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The liquid discharge apparatus may be, for example, an image forming apparatus to form an image on a sheet by discharging ink, or a three-dimensional apparatus to discharge a molding liquid to a powder layer in which powder material is formed in layers, so as to form a three-dimensional article.

The liquid discharge apparatus is not limited to an apparatus to discharge liquid to visualize meaningful images, such as letters or figures. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

Examples of the material on which liquid can be adhered include any materials on which liquid can be adhered even temporarily, such as paper, thread, fiber, fabric, leather, metal, plastic, glass, wood, and ceramic.

The liquid discharge apparatus may be an apparatus to relatively move a liquid discharge head and a material on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head.

Examples of the liquid discharge apparatus further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

The terms "image formation", "recording", "printing", "image printing", and "molding" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

a head body to discharge liquid;

a wiring member to transmit a signal to the head body;

a connector integral with the wiring member that connects the wiring member to the head body and is disposed between the wiring member and the head body; and a protector that covers the head body and the connector, the head body including a fitting portion, the protector including a fitting portion to fit the fitting portion of the head body in a fitting direction, the connector disposed more backward than a leading end of the fitting portion of the protector in the fitting direction.

2. The liquid discharge head according to claim 1, wherein the connector is placed at a position higher than an upper end of the head body with the head body connected to the wiring member.

3. The liquid discharge head according to claim 1, wherein at least one of the fitting portion of the head body and the fitting portion of the protector includes a recessed portion or a cutout portion to partially broaden a clearance between the fitting portion of the head body and the fitting portion of the protector.

4. The liquid discharge head according to claim 1, wherein the fitting portion of the head body includes an engagement portion and the fitting portion of the protector includes an engagement portion to engage the engagement portion of the fitting portion of the head body in the fitting direction.

5. The liquid discharge head according to claim 1, wherein the wiring member includes a bent portion in an area covered with the protector, and wherein a bent angle of the bent portion is equal to or smaller than 90°.

6. The liquid discharge head according to claim 5, wherein the protector includes a port to extend the wiring member out an inside of the protector, and the port is disposed at a position away from a connecting portion of the connector and the head body in a direction perpendicular to the fitting direction.

7. The liquid discharge head according to claim 6, wherein the wiring member includes at least another bent portion in the area covered with the protector, wherein a bent angle of the at least another bent portion is equal to or smaller than 90°; and wherein a surface of the wiring member contacting the connector is parallel to another surface of the wiring member opposing the port.

8. The liquid discharge head according to claim 6, wherein the port is open in the direction perpendicular to the fitting direction.

9. The liquid discharge head according to claim 6, further comprising:

a sealer to seal a clearance between the port and the wiring member.

10. A liquid discharge device comprising:

the liquid discharge head according to claim 1, to discharge liquid.

11. The liquid discharge device according to claim 10, wherein the liquid discharge head is integrated as a single unit with at least one of:

a head tank to store the liquid to be supplied to the liquid discharge head;

a carriage mounting the liquid discharge head;

a supply unit to supply the liquid to the liquid discharge head;

a maintenance unit to maintain and recover the liquid discharge head; and a main scan moving unit to move the liquid discharge head in a main scanning direction.

12. A liquid discharge apparatus comprising:

the liquid discharge device according to claim 10, to discharge the liquid.

13. A liquid discharge apparatus comprising:

the liquid discharge head according to claim 1, to discharge the liquid.

* * * * *